US011166544B2

(12) United States Patent
Goodworth et al.

(10) Patent No.: US 11,166,544 B2
(45) Date of Patent: Nov. 9, 2021

(54) FOLDING TABLE

(71) Applicant: Adams Mfg. Corp., Portersville, PA (US)

(72) Inventors: Matthew Goodworth, Pittsburgh, PA (US); Robert G. Schreiber, Prospect, PA (US); Shlomo Snir, Cranberry Township, PA (US)

(73) Assignee: Adama Mfg. Corp., Portersville, PA (US)

( * ) Notice: Subject to any disclaimer, the term of this patent is extended or adjusted under 35 U.S.C. 154(b) by 0 days.

(21) Appl. No.: 16/720,467

(22) Filed: Dec. 19, 2019

(65) Prior Publication Data

US 2021/0186205 A1 Jun. 24, 2021

(51) Int. Cl.
*A47B 3/02* (2006.01)

(52) U.S. Cl.
CPC ..... *A47B 3/02* (2013.01)

(58) Field of Classification Search
CPC ..... A47B 3/02; A47B 2003/025; A47B 3/083; A47C 4/00; A47C 4/14
USPC ..... 108/115, 119, 118, 174; 297/159.1; 248/432, 168
See application file for complete search history.

(56) References Cited

U.S. PATENT DOCUMENTS 407,824 A * 7/1889 Henry
610,269 A * 9/1898 Hoogkins
628,712 A 7/1899 Hoshour
2,587,010 A * 2/1952 Thompson ..... A47B 3/02 108/171
3,256,840 A * 6/1966 Knoblock ..... A47B 3/12 108/124
3,311,071 A 3/1967 Cook
3,345,959 A * 10/1967 Linstead ..... A47B 3/02 108/119
3,692,358 A * 9/1972 Sung ..... A47B 3/02 297/158.4
4,229,038 A * 10/1980 Drost ..... A47B 3/02 108/173
4,592,287 A * 6/1986 Thygeson ..... A47B 3/02 108/118
4,793,265 A * 12/1988 Morris ..... A47B 3/02 108/118

(Continued)

FOREIGN PATENT DOCUMENTS

DE 9110980 * 10/1991
FR 2559657 * 8/1985

*Primary Examiner* — Janet M Wilkens
(74) *Attorney, Agent, or Firm* — Buchanan Ingersoll & Rooney PC

(57) ABSTRACT

A folding table has two table top portions. A pair of spaced apart arms extends from each table top portion. Each arm is connected to a respective one of four legs. Two sets of two legs are pivotably connected so that each connected pair of legs can be completely aligned with one another or in a crisscrossed position. A handle connected to and between the upper ends of two of the legs has at least one slot which is positioned and configured to receive a hook that extends from the bottom surface of the first table top portion. When the hook is in the slot the hook prevents the first table top portion from moving away from the legs when that table top portion is lifted upward and can also prevent the first table top portion from moving in a direction parallel to the second table top portion.

10 Claims, 14 Drawing Sheets

(56) References Cited

U.S. PATENT DOCUMENTS

| | | | | |
|---|---|---|---|---|
| 5,353,715 | A | 10/1994 | Luyk | |
| 5,584,254 | A | 12/1996 | Williams | |
| D388,638 | S | 1/1998 | Ludlam et al. | |
| D407,235 | S * | 3/1999 | Cunningham | D6/692.1 |
| 5,887,531 | A * | 3/1999 | Covill | A47B 3/083 108/131 |
| D440,070 | S * | 4/2001 | Goodworth | D6/692.1 |
| 6,443,074 | B1 | 9/2002 | Adams et al. | |
| 9,119,465 | B2 * | 9/2015 | Grace | A47B 3/02 |
| 2002/0078864 | A1 * | 6/2002 | Adams | A47B 3/02 108/115 |
| 2003/0172854 | A1 * | 9/2003 | Adams | A47B 3/02 108/115 |
| 2009/0114130 | A1 * | 5/2009 | Chirea | A47B 3/08 108/124 |

* cited by examiner

FOLDING TABLE

BACKGROUND OF THE INVENTION

Field of the Invention

The present invention relates generally to folding tables. More specifically, the present invention concerns a portable, foldable table that is made of lightweight material, is sturdy and can be folded into a compact unit for easy carrying and storage.

Background of the Invention

Some conventional folding tables comprise two table top portions each having a surface and arms which are pivotably connected to a supporting frame. The frame has two pairs of legs that are pivotably connected such that the two pair of legs can be converted from an open position, where the legs form a crisscross pattern and the two table top portions form a flat surface, to a closed position, where the legs are collapsed into a vertical position and the two table top portions are also collapsed such that they are separated and substantially parallel to one another and the legs. Examples of this type of table can be found in U.S. Pat. Nos. 6,666,151, 6,715,429 and Des. 394,361.

One common problem with this type of table is that the two top table portions when in the open position can move relative to one another in longitudinal direction toward and away from one another and transversely, parallel to one another.

Accordingly, the need exists for a foldable, portable table having two table top portions that can be easily locked in place when in an open position so that the table top portions do not move relative to one another during normal use.

SUMMARY OF THE INVENTION

A folding table has a first table top portion and a second table top portion. A pair of spaced apart arms extends from and is attached to the bottom surface of each table top portion. The distal end of each arm is connected to the upper end of a respective one of four legs. Two of the legs are pivotably connected together at a connection area between the upper end and the lower end of each leg. The other two legs are also pivotably connected at their respective connection areas. Consequently the legs in each connected pair of legs can move from a vertical position in which the legs are completely aligned with one another to an angled and crisscrossed position. A handle having a generally cylindrical body is connected to and between the upper end of a first leg and the upper end of a second leg. The handle has at least one slot which is positioned and configured to receive a hook that extends from the bottom surface of the first table top portion.

We prefer to provide two hooks and two slots. The hooks are urged into a corresponding slot in the handle as the table top portions are pushed together. When the table top portions are pulled away from one another the hooks will move out of the slots. When the hooks are in the slots they will prevent the first table top portion from moving away from the legs when that table top portion is lifted upward. The connection can also prevent the first table top portion from moving in a direction parallel to the second table top portion.

We also prefer to provide a male member extending from a face of the first table top portion and a female member on a face of the second table top portion. The female member has an opening that is sized and configured to receive the male member. When the male member is within the opening this joint will, during normal use, prevent the first table top portion from moving away from second table top portion in a longitudinal direction and prevent relative motion of the table top portions in a transverse direction parallel to one another.

Other features and advantages of our folding table will become apparent from a description of certain present preferred embodiments thereof that are shown on the drawings.

DESCRIPTION OF THE PREFERRED EMBODIMENTS

Figure 2:
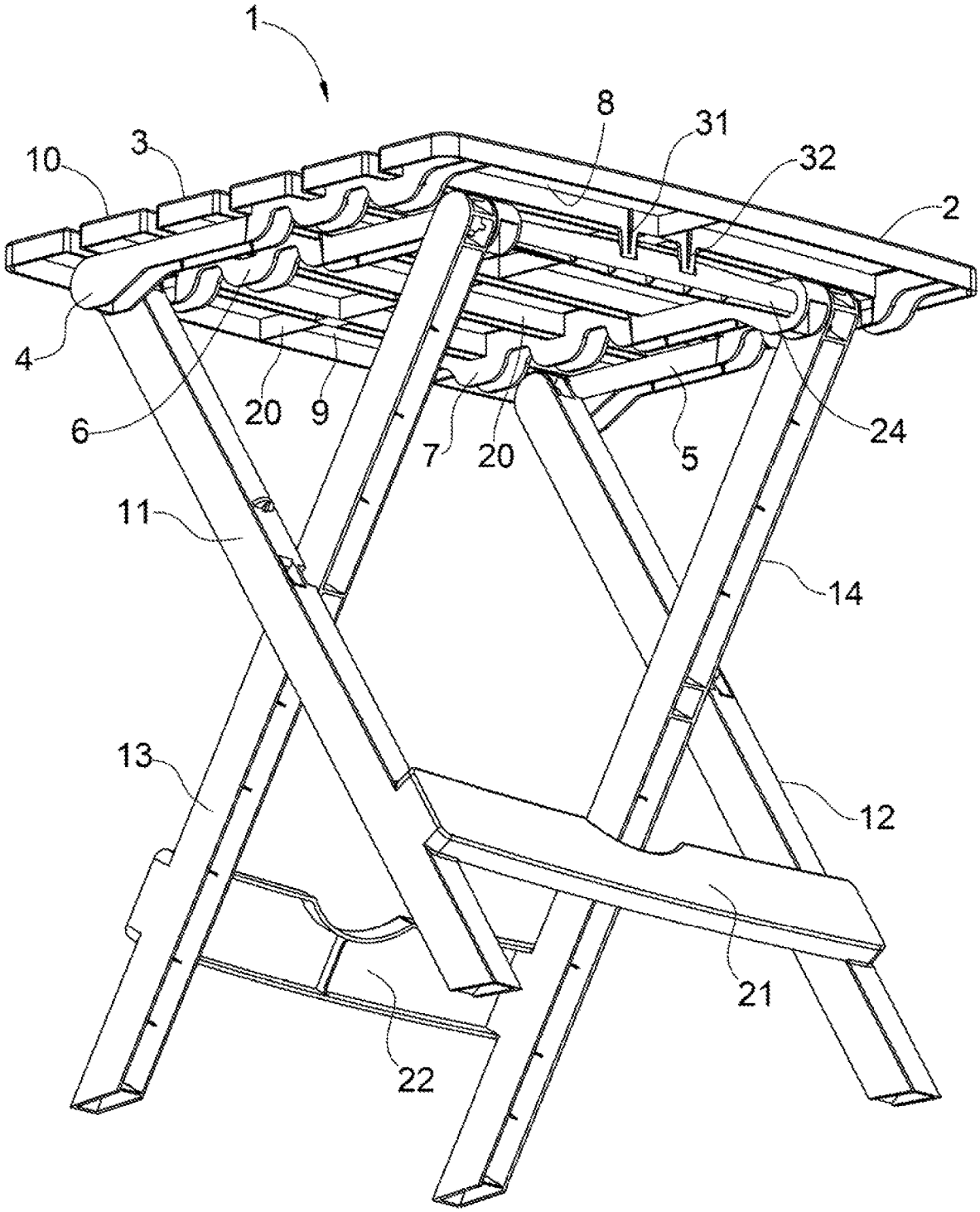
FIG. 2 is a perspective view of the folding table shown in FIG. 1 in the open position in which the opposite side and bottom surface of the table can be seen and the two table top portions are together and locked in place.
Figure 3:
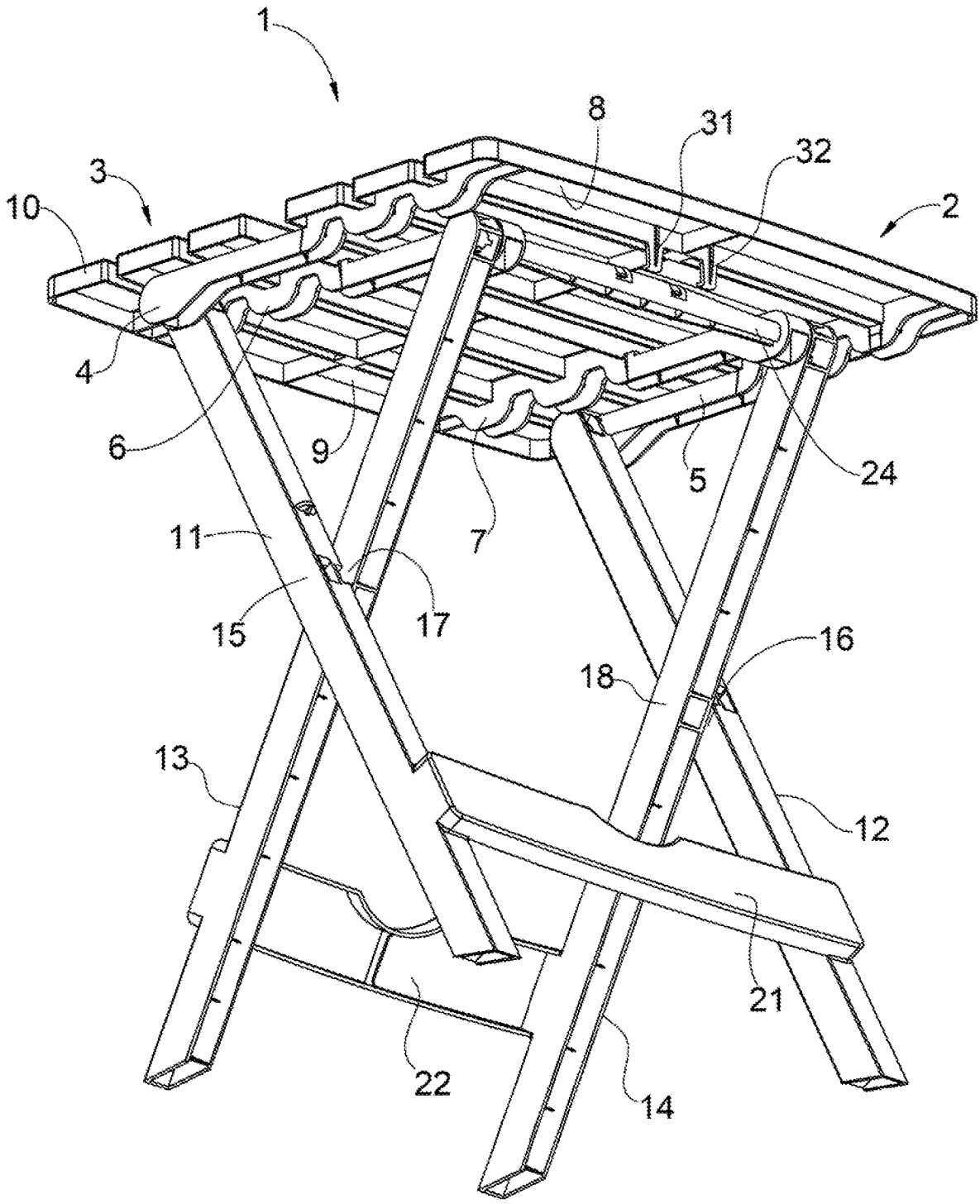
FIG. 3 is a perspective view of the folding table shown in FIG. 2 when the table top portions are spaced apart from one another and not locked in place.
Figure 4:
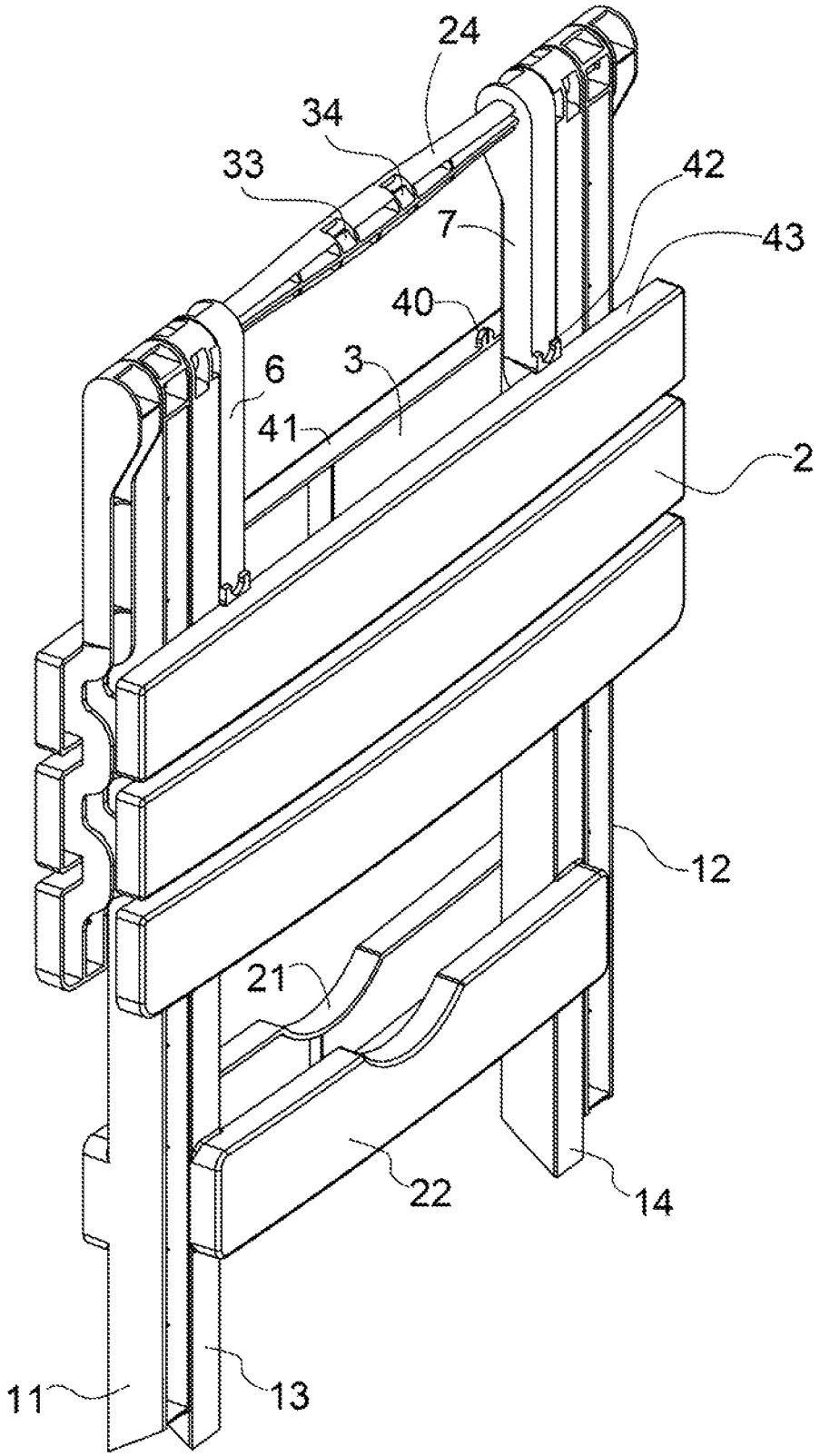
FIG. 4 is a perspective view of the folding table shown in FIGS. 1 and 2 in a folded closed position.
Figure 5:
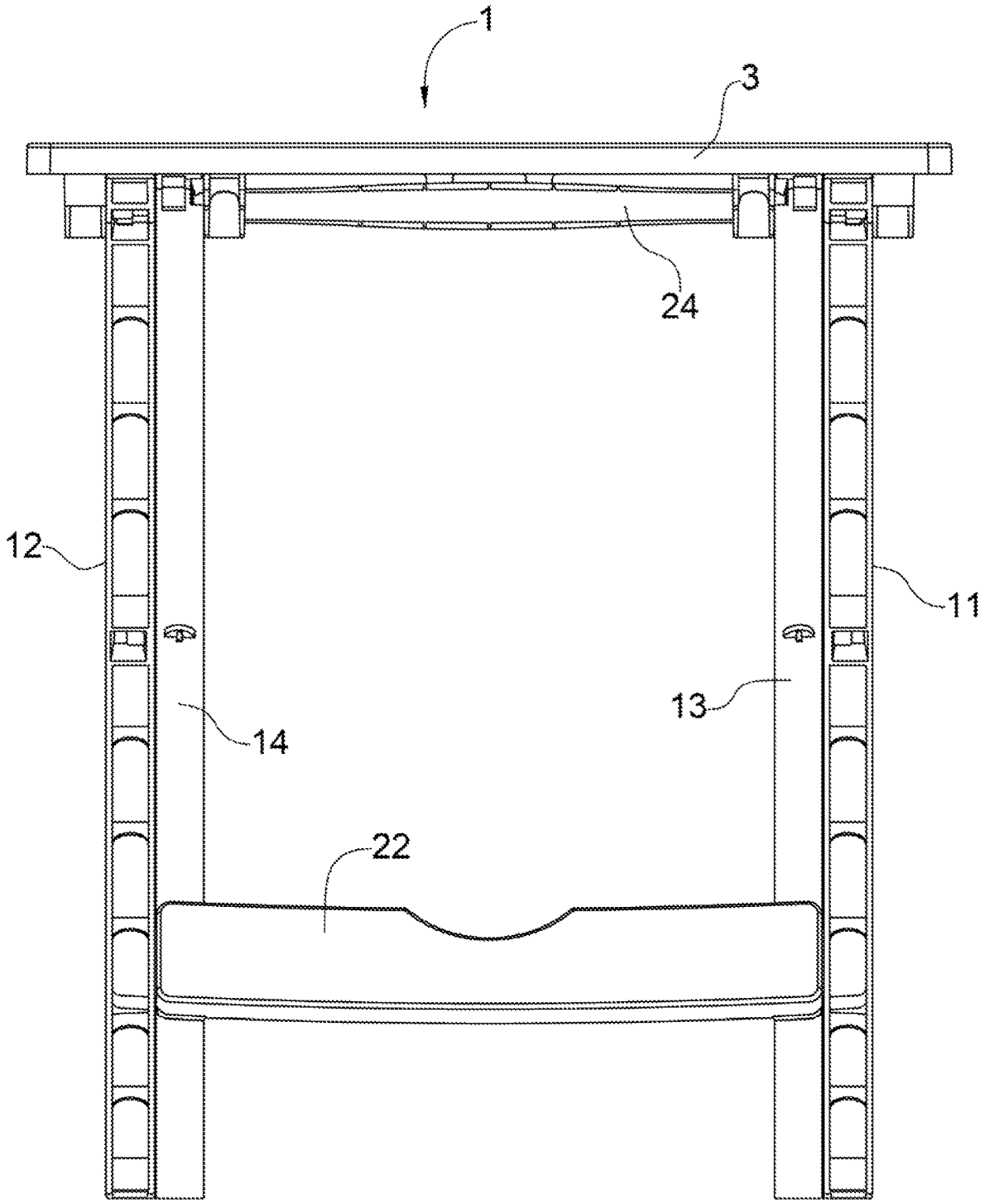
FIG. 5 is a front view of the folding table shown in FIGS. 1 and 2.
Figure 6:
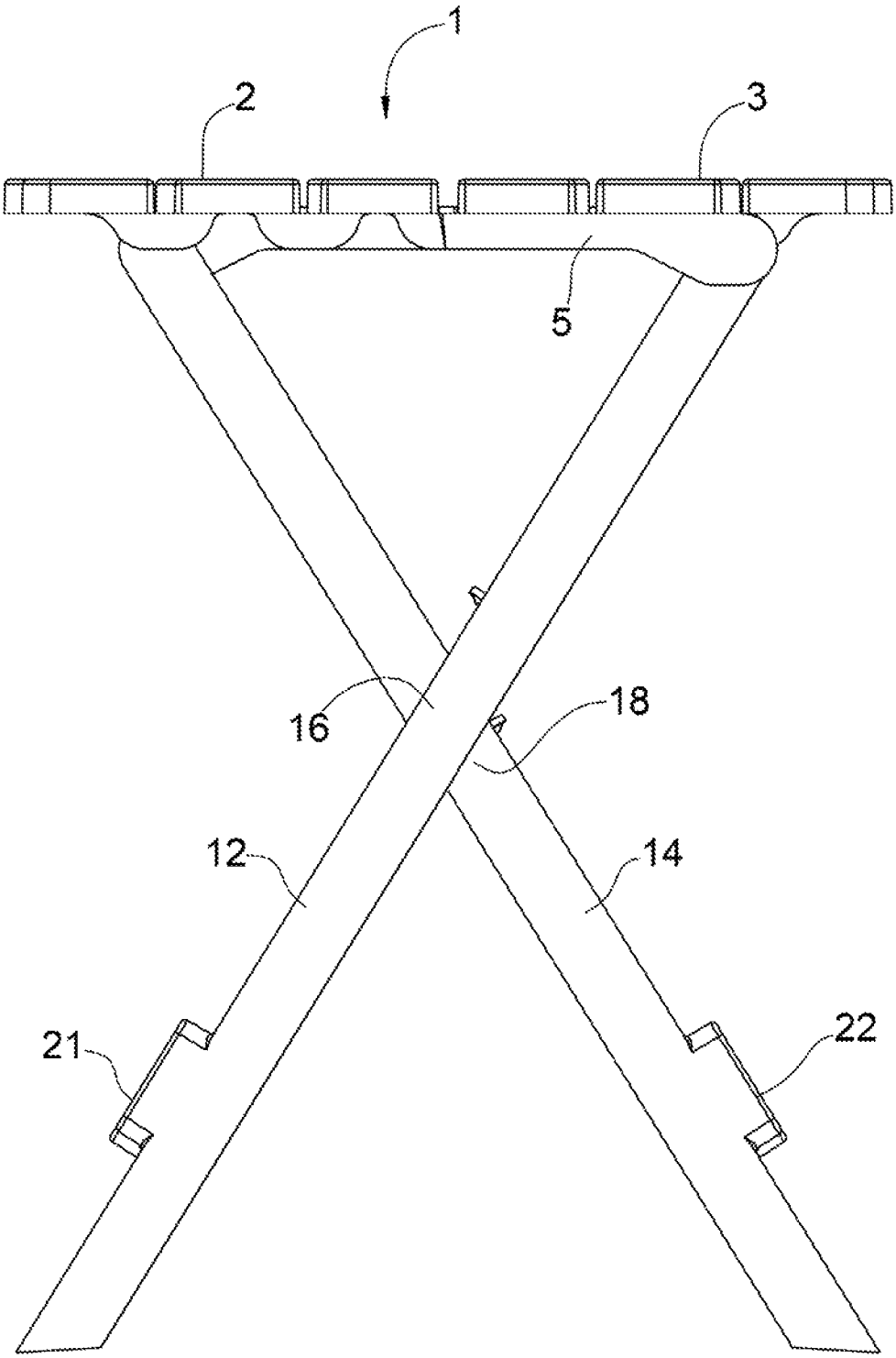
FIG. 6 is a left side view of the folding table shown in FIGS. 1 and 2.
Figure 7:
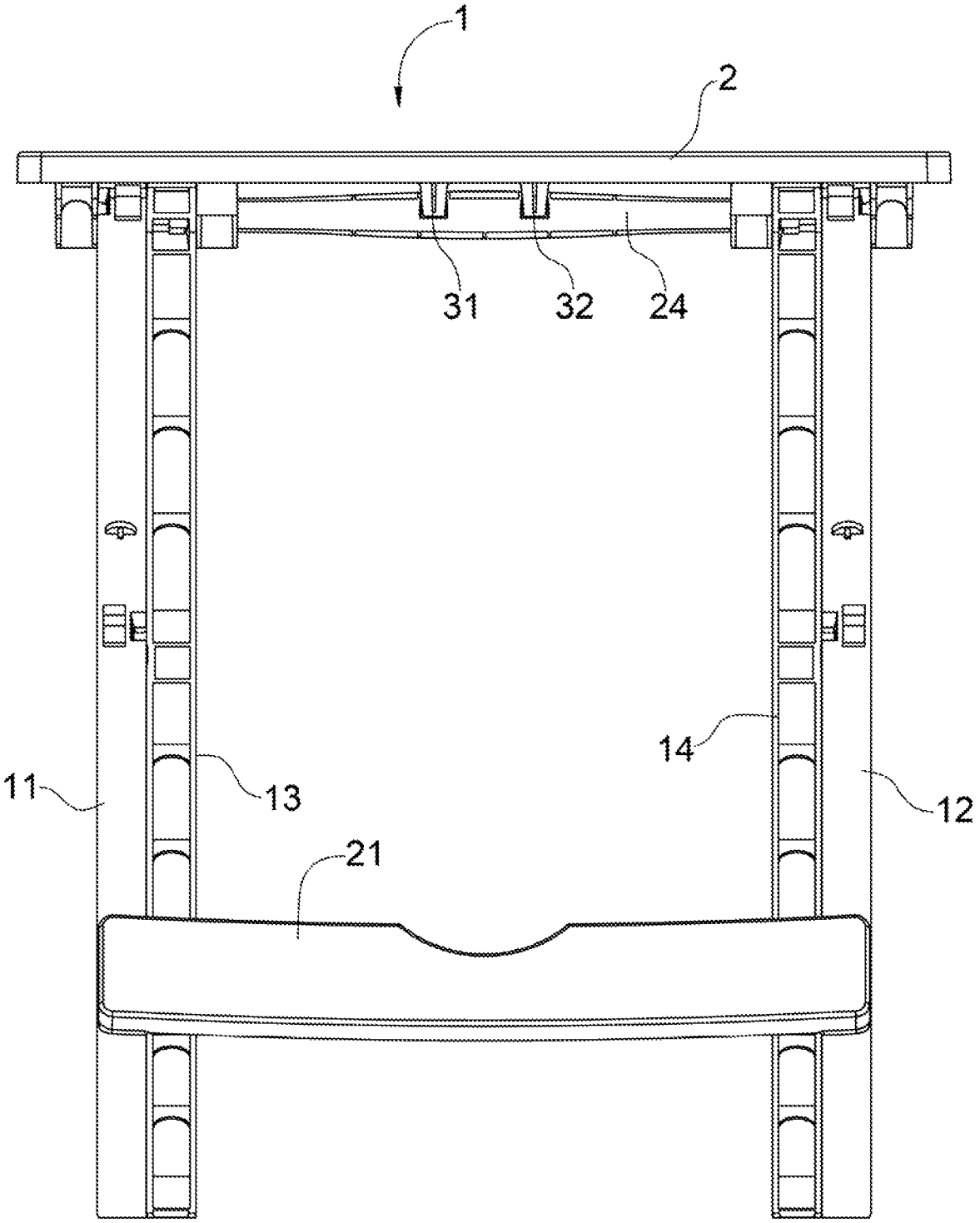
FIG. 7 is rear view of the folding table shown in FIGS. 1 and 2.
Figure 8:
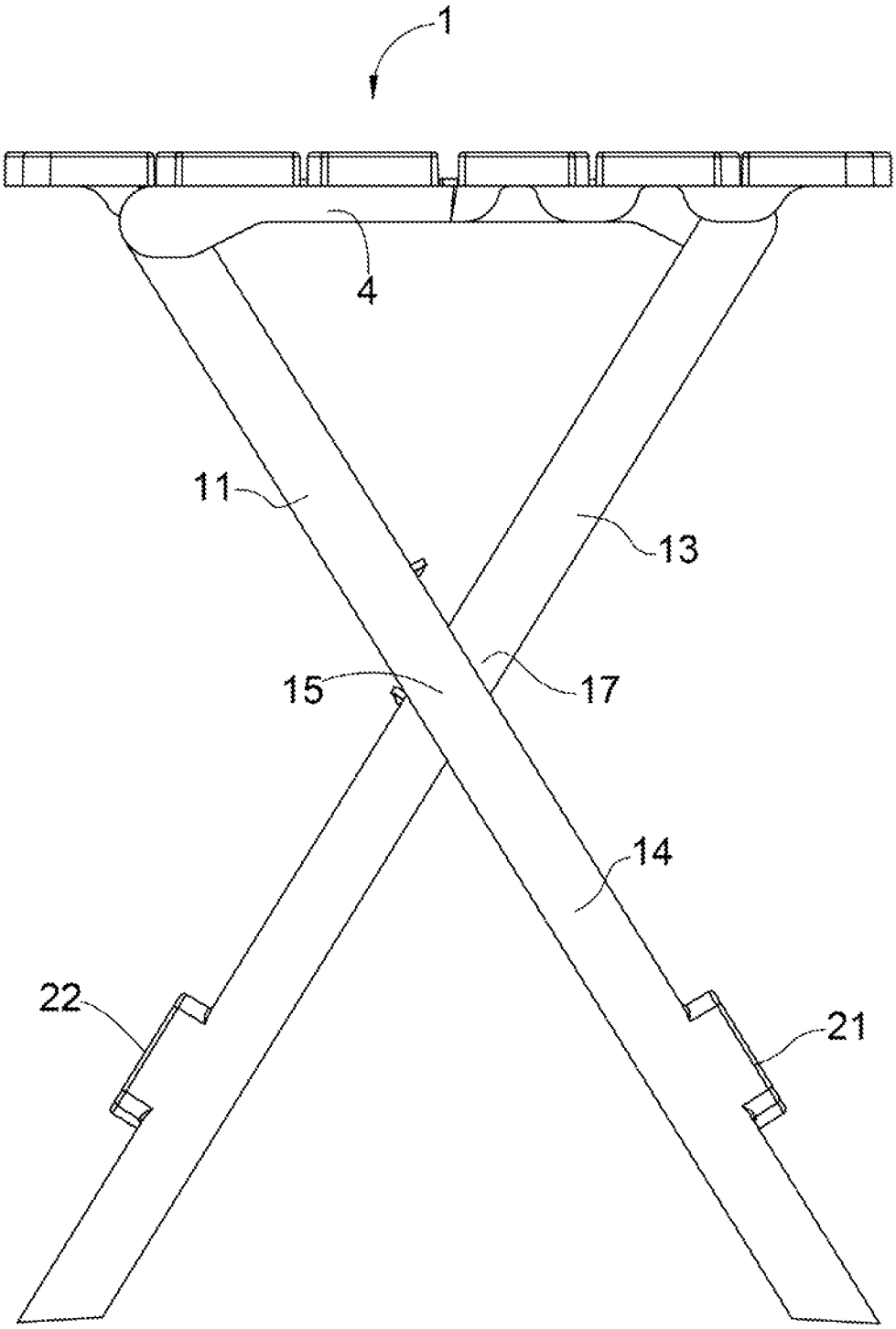
FIG. 8 is a right side view of the folding table shown in FIGS. 1 and 2.

Referring to FIGS. 1 through 4 our folding table 1 has a first table top portion 2, a second table top portion 3 and four legs 11, 12, 13 and 14. We prefer that the table top portions 2, 3 have a series of spaced-apart slats 10. Arms 4 and 5 each have one end attached to the bottom surface 8 of the first table top portion 2. The opposite end of the first arm 4 is pivotably attached to the upper end of the first leg 11. The opposite end of the second arm 5 is pivotably attached to the upper end of the second leg 12. Arms 6 and 7 have one end attached to the bottom surface 9 of the second table top portion 3. The opposite end of the third arm 6 is pivotably attached to the upper end of the third leg 13. The opposite end of the fourth arm 7 is pivotably attached to the upper end of the fourth leg 14. Arms 4 and 5 are spaced apart from one another and are substantially parallel to one another. Arms 6 and 7 are also spaced apart from one another and are substantially parallel to one another. It should be noted that the arms 4 and 5 are spaced apart a greater distance than the distance that arms 6 and 7 are spaced from one another such that all of the arms can lie in the same horizontal plane when the folding table 1 is in the fully assembled position (FIG. 2) and can lie in the same vertical plane when the folding table 1 is in the fully collapsed position (FIG. 4). Ribs 20 extend along the underside of the table top portions 2, 3 to strengthen the table top portions.

Each of the legs 11, 12, 13 and 14 has a connection area 15, 16, 17 and 18 between the upper end and the lower end of the leg. The first leg 11 at connection area 15 is pivotably attached to the third leg 13 at connection area 17. The second leg 12 at connection area 16 is pivotably attached to the fourth leg 14 at connection area 18. A first brace 21 is connected between the first leg 11 and the second leg 12. A second brace 22 is connected between the third leg 13 and the fourth leg 14.

A handle 24, seen most clearly in FIGS. 2, 3 and 4, extends between the end of arm 6 where that end is connected to the upper end of the third leg 13 and the end of arm 7 where that end is connected to the upper end of the fourth leg 14. The handle 24 is connected to the arms 6 and 7 such that the handle 24 is substantially perpendicular to those arms. The handle has two slots 33, 34 that are positioned and configured to receive one of two hooks 31, 32 that extend from the bottom surface 8 of the first table top portion 2. Preferably the handle is generally cylindrical and has a larger diameter at its center than at its ends as can be seen in FIG. 4. The handle 24 may have a waffle shaped cross-section. However, it will be apparent to one of ordinary skill in the art that many other configurations may be employed.

Figure 1:
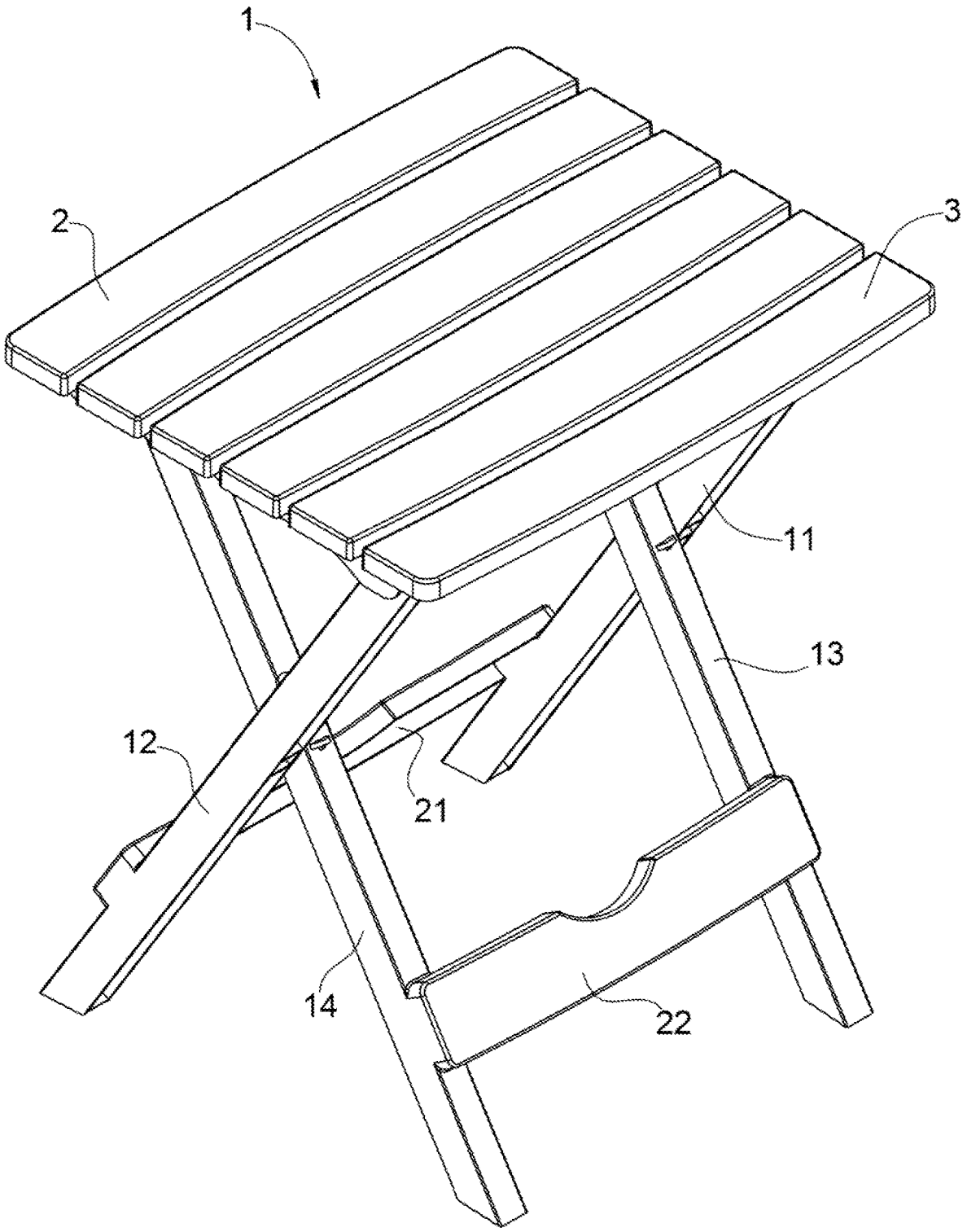
FIG. 1 is a perspective view of a present preferred embodiment of our folding table in the open position in which the top surface of the table can be seen.
Figure 14:
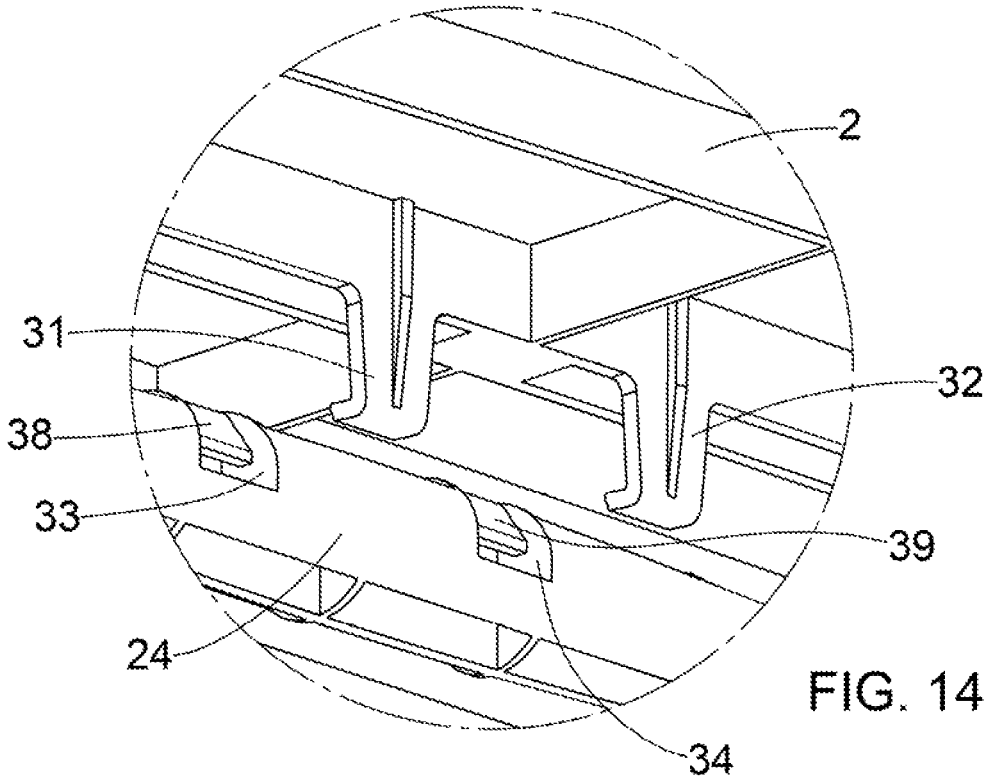
FIG. 14 is a fragmentary view similar to FIG. 13 showing the hooks before they are engaged in the slots in the handle.

The hooks 31, 32 and slots 33, 34 may be configured as shown most clearly in FIG. 14. The hooks 31, 32 are urged into a corresponding slot 33, 34 as the table top portions 2, 3 are pushed together from their positions shown in FIG. 3 to abut one another as shown in FIGS. 1 and 2. When the table top portions 2, 3 are pulled away from one another the hooks 31, 32 will move out of the slots 33, 34.

Figure 9:
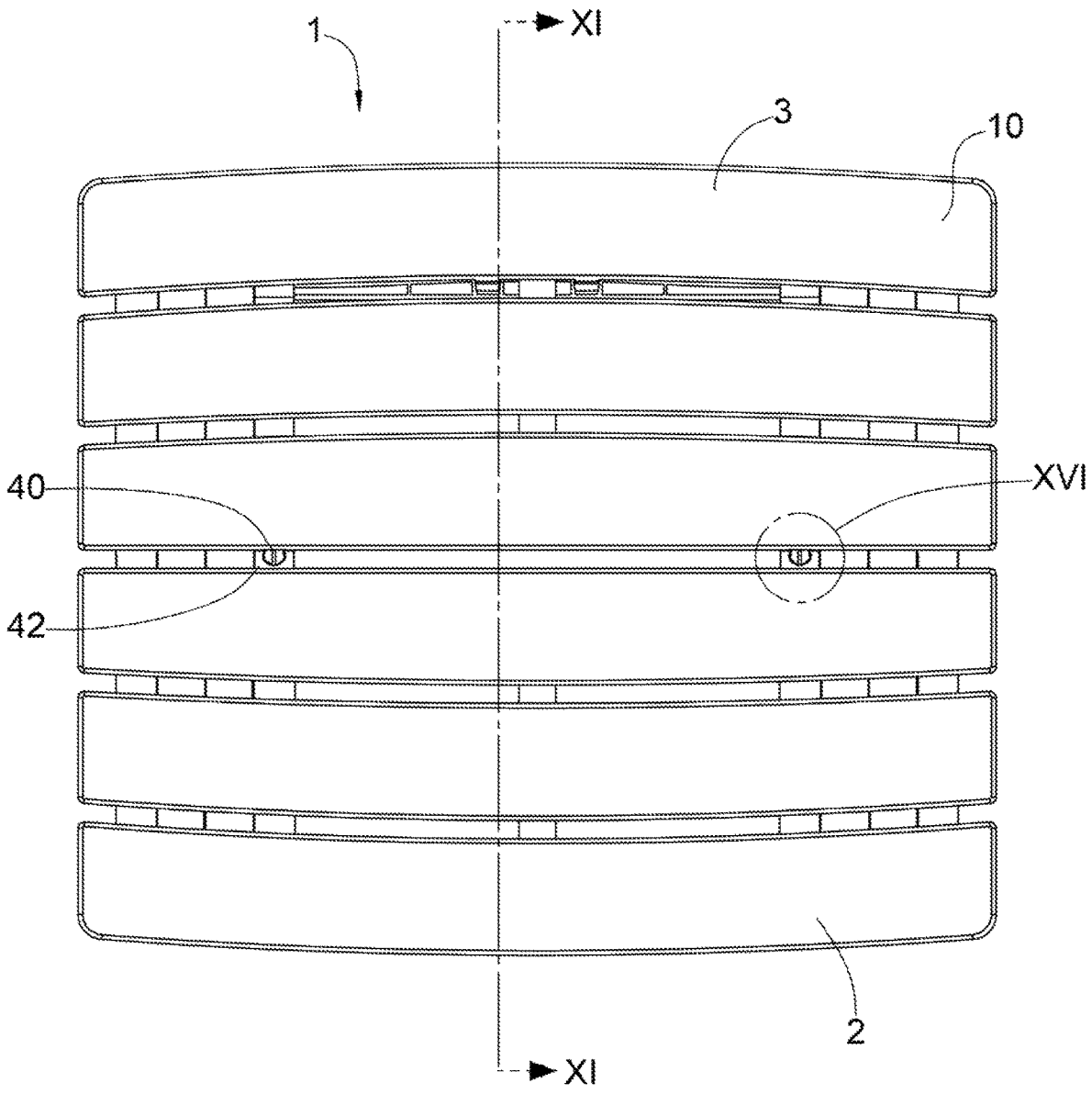
FIG. 9 is top view of the folding table shown in FIGS. 1 and 2.
Figure 10:
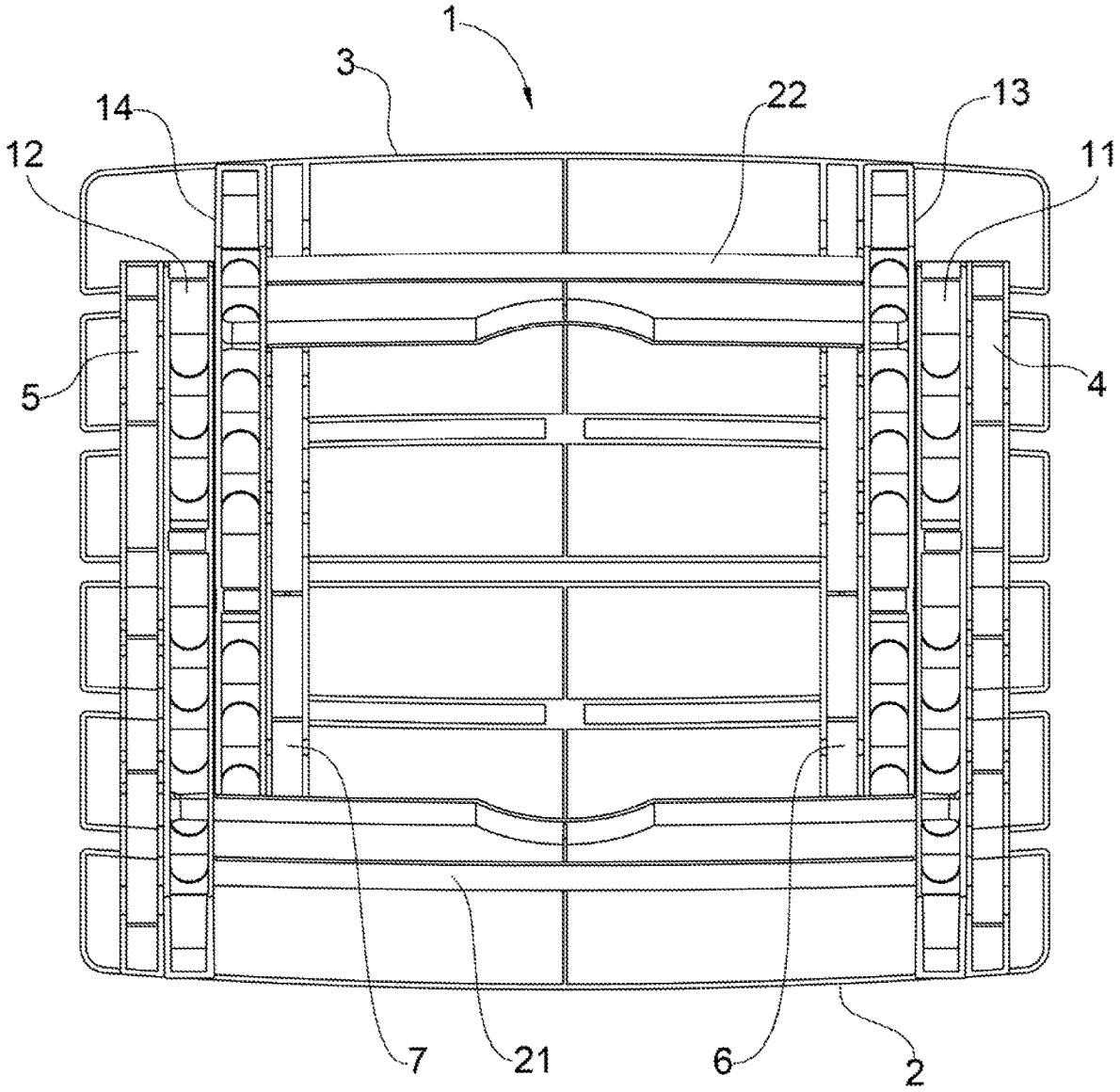
FIG. 10 is a bottom view of the folding table shown in FIGS. 1 and 2.
Figure 15:
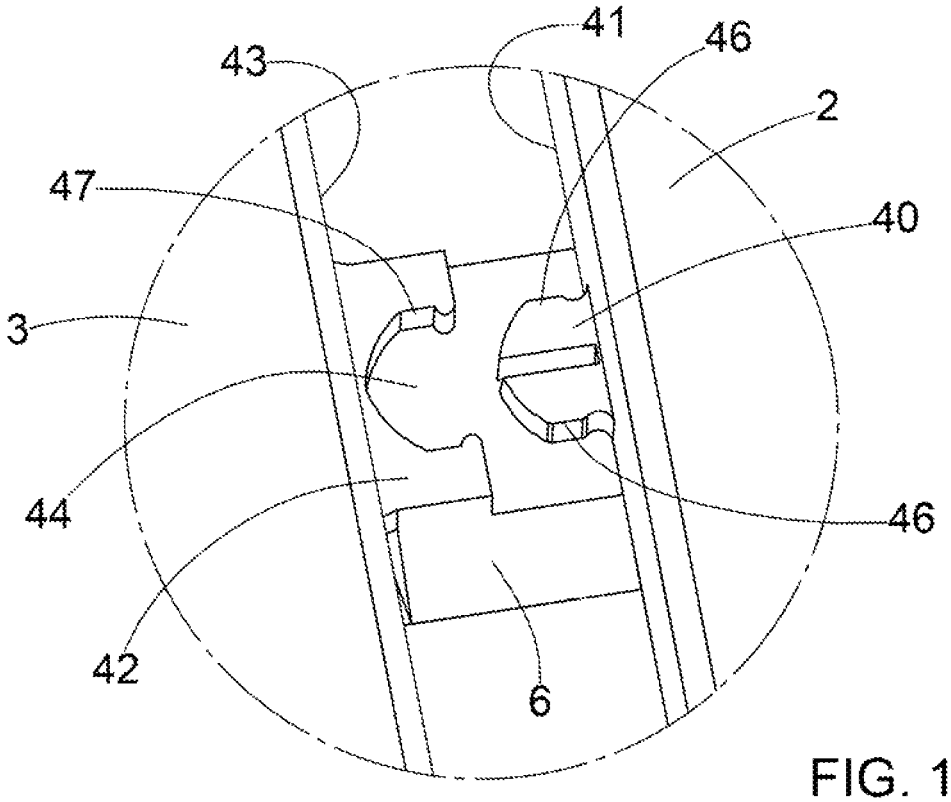
FIG. 15 is an enlarged view of a portion of the folding table within the broken line circle XVI in FIG. 9 showing the male member on the first table top portion and the female member on the second table top portion before they are connected together.
Figure 16:
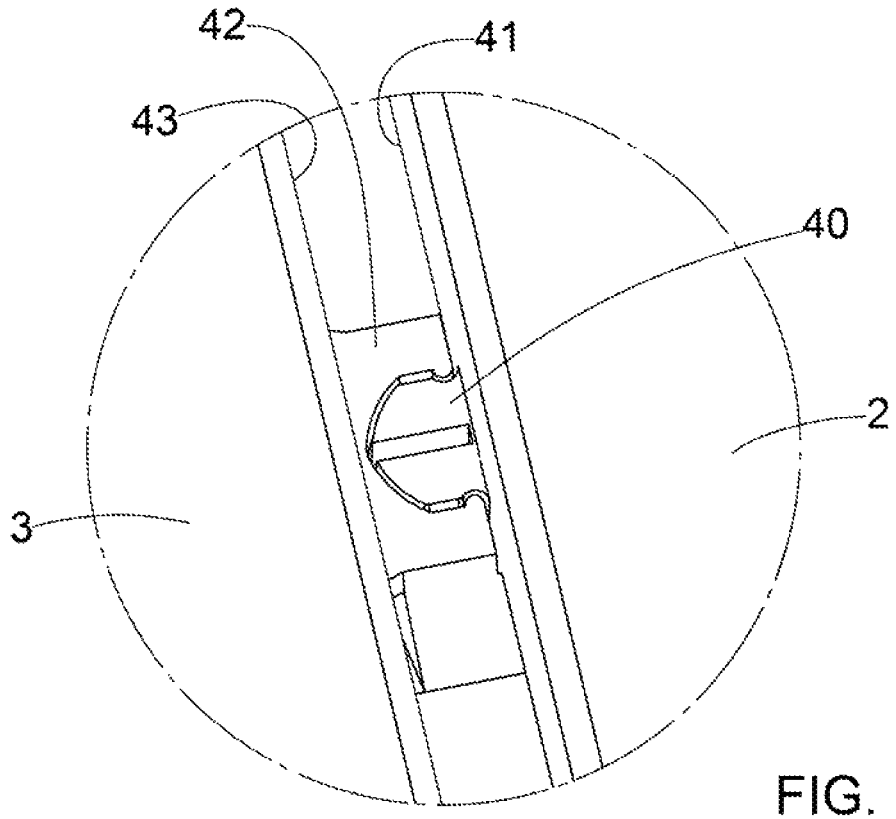
FIG. 16 is an enlarged view similar to FIG. 15 showing the male member on the first table top portion within the opening in the female member on the second table top portion.

As can be seen in FIGS. 9, 15 and 16 we also prefer to provide male members 40 extending from the face 41 of the first table top portion 2 and corresponding female members 42 on the face 43 of the second table top portion 3. Each female member has an opening 44 that is sized and configured to receive a male member 40. When the male member 40 is within the opening 44 this joint will, during normal use, prevent the first table top portion 2 from moving away from the second table top portion 3 in a longitudinal direction and prevent relative motion of the table top portions 2, 3 in a transverse direction parallel to one another.

The male members 40 shown in the drawings each have a projection 46 on opposite sides and the opening 44 in each female member 42 has corresponding recesses 47 to provide a joint that resists both longitudinal motion and transverse motion and provides a snap fit. Although not illustrated, the male members and the corresponding openings in the female members can take many other sizes and shapes as should be apparent to one of ordinary skill in the art.

The folding table 1 is preferably made of polycarbonate, ABS or polypropylene but can be made of other plastics, wood or metal. Although the table top portions 2, 3 are rectangular they can be semicircular, shaped to provide an oblong table, or any other desired shape and may be any desired size.

Figure 12:
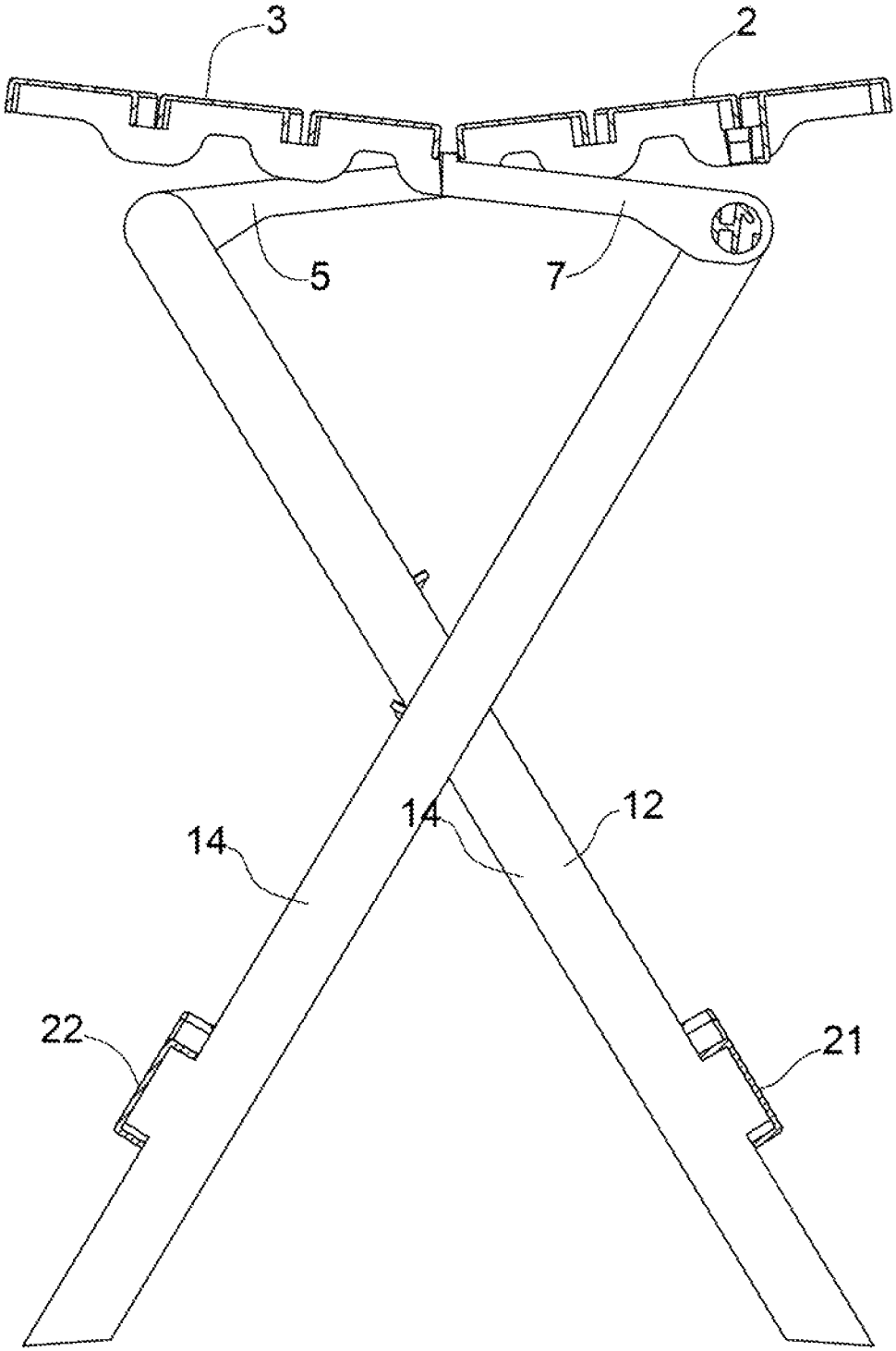
FIG. 12 is a left side view similar to FIG. 11 in which each of the two top table portions are above the upper ends of the legs.
Figure 13:
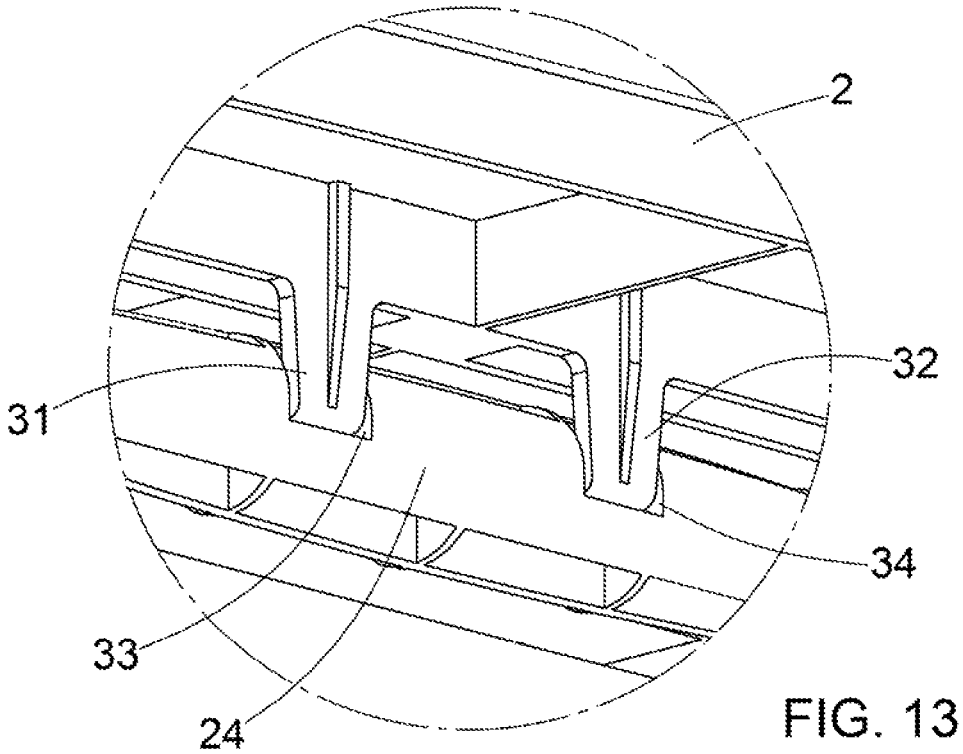
FIG. 13 is a fragmentary view of the bottom of the first table to portion showing the hooks engaged in the slots in the handle.

To change the table from the folded position shown in FIG. 4 to the position for use shown in FIGS. 1 and 2 the user grasps the first and second table top portions 2 and 3 at their distal ends and pulls the table top portions 2, 3 away from one another. Then the user moves the table top portions from the near vertical position to a near horizontal position pushing the upper ends of legs 11, 12 away from the upper ends of legs 13, 14. While the first and second table top portions 2 and 3 are moving to the near horizontal position, the legs are moving from a vertical position (FIG. 4) to an angled and crisscrossed position so that the table is configured as shown in FIG. 12. Then the user lowers the distal end of each of the table top portions 2, 3 such that the table top portions are positioned as shown in FIG. 3. At that point the hooks 31, 32 will be spaced apart from the slots 33, 34 as shown in FIGS. 3 and 14 and each male member 40 will be spaced apart from a corresponding female member 42 as shown in FIG. 15. Next the user pushes the table top portions 2, 3 together to the positions shown in FIGS. 1 and 2. This causes the hooks 31, 32 to move into the slots 33, 34 and be positioned as shown in FIGS. 2 and 14 and causes each male member 40 to be within the opening 44 of a corresponding female member 42 as shown in FIGS. 9 and 16. The hooks 31, 32 in the slots 33, 34 prevent the table top portions 2, 3 from moving away from the legs 11, 12, 13, 14 when one lifts one or both of the table top portions upward and also resists transverse motion of the table top portions. The joined male and female members resist both longitudinal motion and transverse motion of the table top portions.

Figure 11:
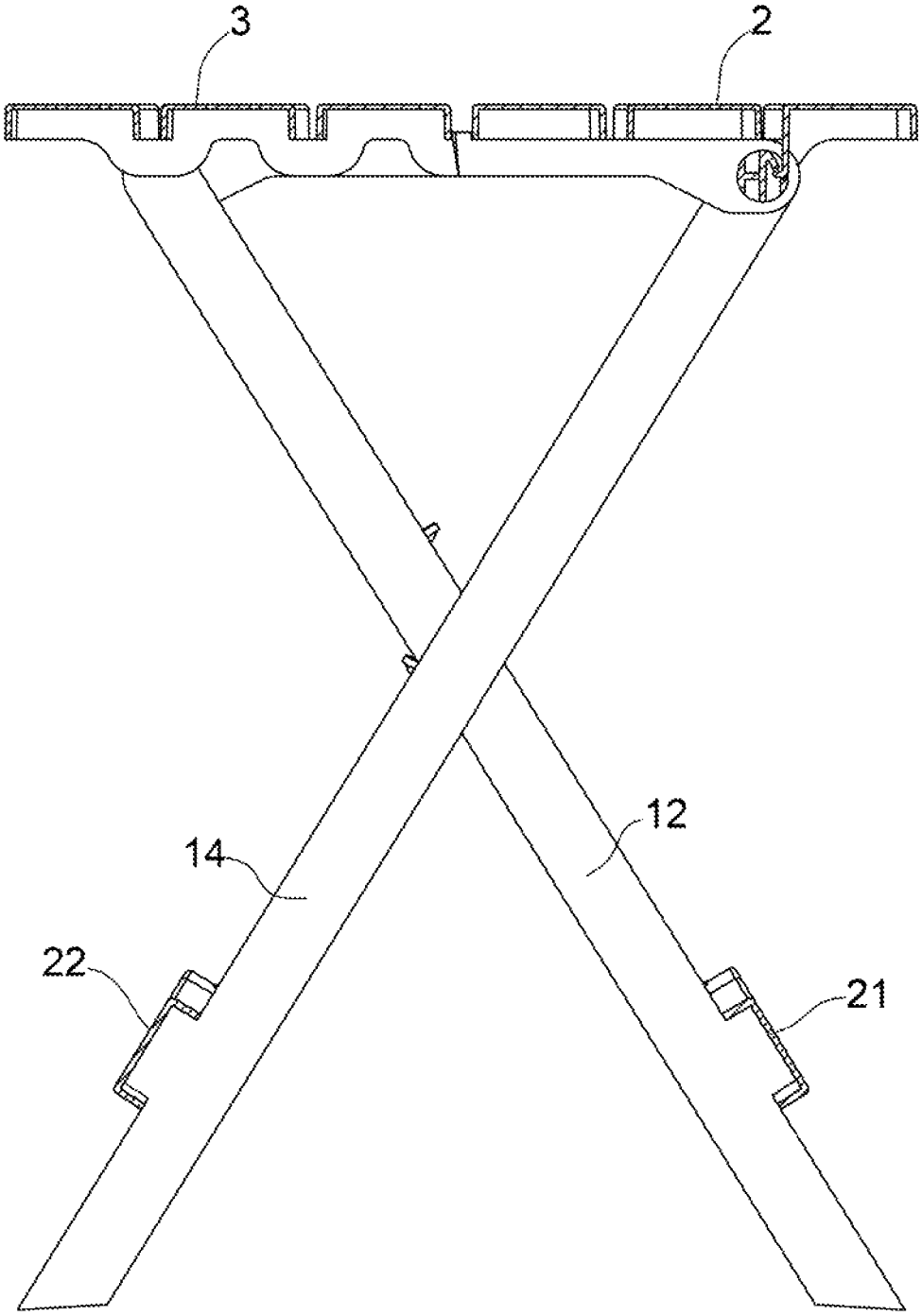
FIG. 11 is a sectional view taken along the line XI-XI in FIG. 9.

A second method to change the table from the folded position shown in FIG. 4 to the position for use shown in FIGS. 1 and 2 is to engage the male and female members on an angle as shown in FIG. 12. Then press the table top 2 down so the hooks 31, 32 slide over the ramps 38, 39 and snap into the handle slots 33, 34 as shown in FIG. 11. The male members 40 will lay down inside the female members 42 from a vertical position. The user can pull up on the table top 2 to snap release the hooks. The male members 40 will lift vertically out of the female members 42.

Although we could make the folding table without either the hooks and slots or the male member and female member joints, we prefer to provide both features. This combination provides greater stability than either feature alone.

In order to transform the folding table 1 from the fully assembled position to the fully collapsed position, the user pulls the first table top portion 2 away from the second table top portion 3 thereby disengaging the hooks 31, 32 from the slots 33, 34 and removing each male member 40 from the opening 44 in its corresponding female member 42. Then the user lifts the distal ends of the table top portions 2, 3 and continues pulling them away from one another until the legs are in a common plane. Then the user lowers the distal ends of the table top portions until the table top portions are positioned as in FIG. 4.

Although we have illustrated and described certain present preferred embodiments of our folding table it should be distinctly understood that our invention is not limited thereto, but may be variously embodied within the scope of the following claims.

We claim:

1. A folding table, comprising:

a first table top portion, the first table top portion having a top surface and a bottom surface;

a second table top portion;

a first pair of legs comprised of a first leg and a third leg each leg having an upper end and a lower end and a connection area between the upper end and the lower end, the first leg pivotably connected to the third leg at their respective connection areas;

a second pair of legs comprised of a second leg and a fourth leg each leg having an upper end and a lower end and a connection area between the upper end and the lower end, the second leg pivotably connected to the fourth leg at their respective connection areas;

a handle having a generally cylindrical body connected to and between the upper end of the third leg and the upper end of the fourth leg, the handle having at least one slot which is positioned and configured to receive a hook;

a first pair of arms comprised of a first arm and a second arm, each arm having a first end and a second end, the first end of the first arm pivotably attached to the upper end of the first leg, the second end of the first arm connected to the first table top portion, the first end of the second arm pivotably attached to the upper end of the second leg, and the second end of the second arm connected to the first table top portion;

a second pair of arms comprised of a third arm and a fourth arm, each arm having a first end and a second end, the first end of the third arm pivotably attached to the upper end of the third leg, the second end of the third arm connected to the second table top portion, the first end of the fourth arm pivotably attached to the upper end of the fourth leg, and the second end of the fourth arm connected to the second table top portion;

at least one hook extending from the bottom surface of the first table top portion, the at least one hook positioned and configured to fit into the at least one slot in the handle by moving the first table top portion to a position in which the at least one hook is spaced apart from the at least one slot in the handle in a plane parallel to the bottom surface of the first table top portion, the plane passing through the hook and the handle, and pushing the first table top portion toward the second table top portion until the at least one hook is within the at least one slot, thereby preventing movement of the first table top portion in at least one direction; and a ramp in the at least one slot in the handle, the ramp being sized and positioned such the when the at least one hook is positioned above the ramp, pushing the first table top portion toward the handle will cause the at least one hook to slide over the ramp into the at least one slot.

2. The folding table of claim 1 also comprising a first brace connected between the first leg and the second leg.

3. The folding table of claim 1 also comprising a second brace connected between the third leg and the fourth leg.

4. The folding table of claim 1 wherein the first table top portion has a first face that faces the second table portion when the folding table is in the open and locked position and the second table top portion has a second face that faces the first face of the first table top portion when the folding table is in the open and locked position also comprising a male member extending from one of the first face and the second face and a female member on the other of the first face and the second face, the female member having an opening that is sized and configured to receive the male member and prevent relative motion between the first table top portion and the second table top portion in at least one direction.

5. The folding table of claim 4 wherein the male member and the opening in the female member are configured to provide a snap fit.

6. The folding table of claim 1 wherein the first table top portion is comprised of a first plurality of interconnected spaced-apart slat members.

7. The folding table of claim 1 wherein the second table top portion is comprised of a second plurality of interconnected spaced-apart slat members.

8. The folding table of claim 1 wherein the at least one hook extending from the bottom surface of the first table top portion is a pair of spaced apart hooks and the at least one slot which is positioned and configured to receive a hook is comprised of two slots positioned and configured to receive the pair of spaced apart hooks.

9. The folding table of claim 1 wherein the folding table is made of polycarbonate, ABS or polypropylene.

10. A folding table comprising:

a first table top portion, the first table top portion having a top surface and a bottom surface;

a second table top portion;

a first pair of legs comprised of a first leg and a third leg each leg having an upper end and a lower end and a connection area between the upper end and the lower end, the first leg pivotably connected to the third leg at their respective connection areas;

a second pair of legs comprised of a second leg and a fourth leg each leg having an upper end and a lower end and a connection area between the upper end and the lower end, the second leg pivotably connected to the fourth leg at their respective connection areas;

a handle having a generally cylindrical body connected to and between the upper end of the third leg and the upper end of the fourth leg, the handle having at least one slot which is positioned and configured to receive a hook;

a first pair of arms comprised of a first arm and a second arm, each arm having a first end and a second end, the first end of the first arm pivotably attached to the upper end of the first leg, the second end of the first arm connected to the first table top portion, the first end of the second arm pivotably attached to the upper end of the second leg, and the second end of the second arm connected to the first table top portion;

a second pair of arms comprised of a third arm and a fourth arm, each arm having a first end and a second end, the first end of the third arm pivotably attached to the upper end of the third leg, the second end of the third arm connected to the second table top portion, the first end of the fourth arm pivotably attached to the upper end of the fourth leg, and the second end of the fourth arm connected to the second table top portion; and at least one hook extending from the bottom surface of the first table top portion, the at least one hook positioned and configured to fit into the at least one slot in the handle portion when the top portion is in an open and locked position, thereby preventing movement of the first table top portion in at least one direction; and a ramp in the at least one slot in the handle, the ramp being sized and positioned such the when the at least one hook is positioned above the ramp, pushing the first table top portion toward the handle will cause the at least one hook to slide over the ramp into the at least slot.

* * * * *